United States Patent [19]

Morita et al.

[11] Patent Number: 4,628,684

[45] Date of Patent: Dec. 16, 1986

[54] METHOD OF PIECING A YARN IN AN OPEN-END SPINNING MACHINE

[75] Inventors: Takayuki Morita; Akira Tanaka, both of Kariya; Takahiko Tsunekawa; Hisao Amano, both of Aichi, all of Japan

[73] Assignee: Kabushiki Kaisha Toyoda Jidoshokki Seisakusho, Kariya, Japan

[21] Appl. No.: 540,824

[22] Filed: Oct. 11, 1983

[30] Foreign Application Priority Data

Oct. 13, 1982 [JP] Japan ..... 57-179475

[51] Int. Cl.[4] ..... D01H 15/02

[52] U.S. Cl. ..... 57/263; 57/302

[58] Field of Search ..... 57/261, 263, 302

[56] References Cited

U.S. PATENT DOCUMENTS

| | | | |
|---|---|---|---|
| 3,810,352 | 5/1974 | Miyazaki et al. | 57/263 |
| 4,047,371 | 9/1977 | Stahlecker | 57/263 |
| 4,107,957 | 8/1978 | Stahlecker et al. | 57/263 |
| 4,120,140 | 10/1978 | Raasch et al. | 57/263 |
| 4,172,357 | 10/1979 | Stahlecker et al. | 57/263 |
| 4,276,741 | 7/1981 | Stahlecker et al. | 57/263 |

*Primary Examiner*—John Petrakes
*Attorney, Agent, or Firm*—Brooks Haidt Haffner & Delahunty

[57] ABSTRACT

A yarn piecing method in an open-end spinning machine comprises stopping a yarn piecing machine in front of a spinning unit suffering a yarn breakage, reversing a package with a rewinding roller to rewind a yarn therefrom, cutting off the yarn to provide a yarn end having a predetermined length, moving the yarn end to a position upwardly of an outlet of a withdrawal tube in the spinning unit, reversing the rewinding roller again to feed the yarn end through the withdrawal tube to a fiber collecting surface of a spinning rotor in the spinning unit, supplying a sliver with a feed roller into the spinning unit, piecing the yarn end to the sliver on the fiber collecting surface, continuously drawing a pieced yarn from the spinning rotor, and moving the pieced yarn to a position between a presser roller and a draw-off roller which are being rotated while drawing the pieced yarn from the spinning rotor. The presser roller and the draw-off roller are mounted on the open-end spinning machine and adjustable in speed dependent on the yarn number count used for yarn winding operation during a yarn piecing process.

4 Claims, 28 Drawing Figures

P
17
16
Y
70
14
15
13
2
8
11
12
10
F
77
20
35
36
37
41
21
19a
19b
22
72
67
66
73
38
CL
P1
P2
P3
9
7
3
18
24
25
31
23
LS1
LS2
LS3
57
59
66
67
15

FIG.14ℓ
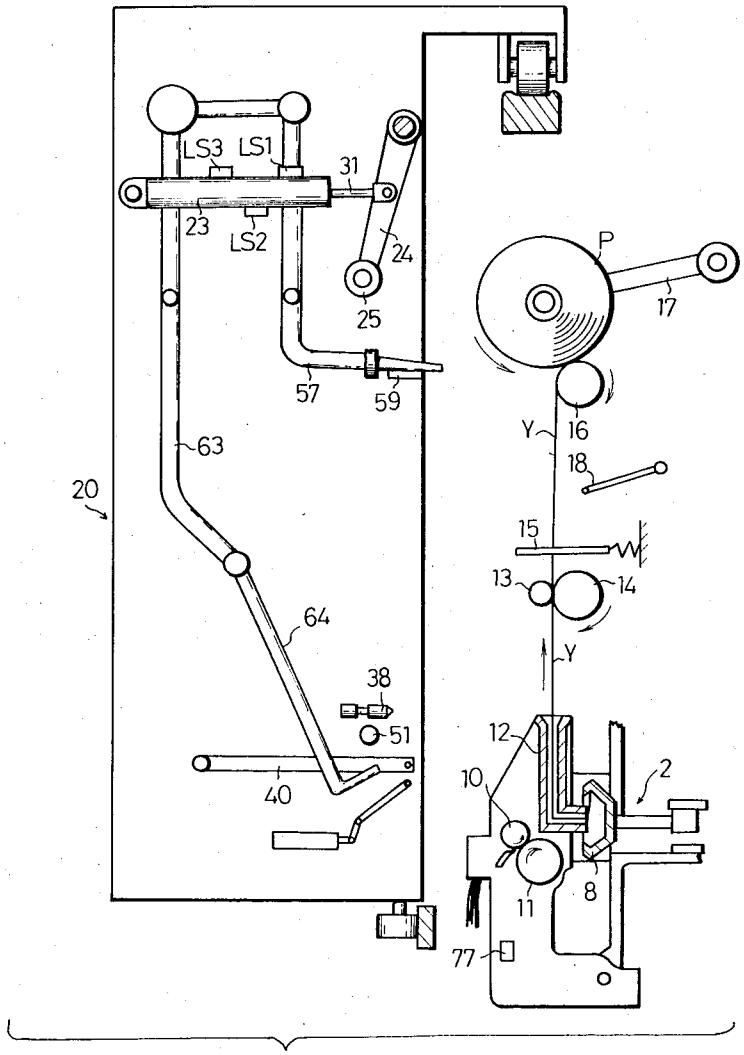
FIG.14k
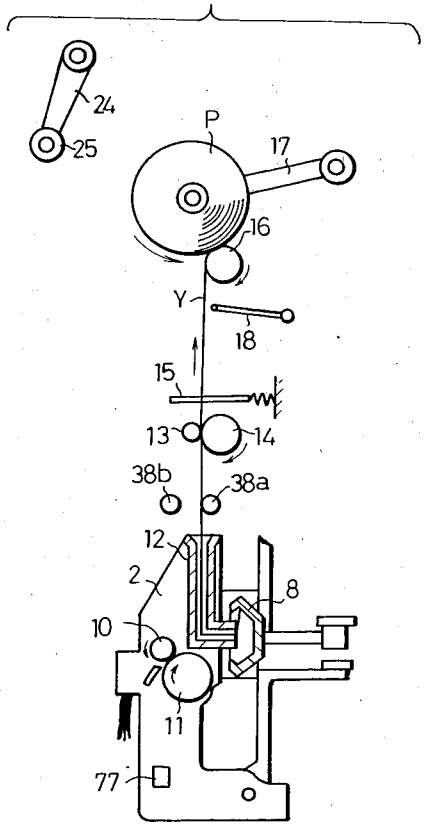

METHOD OF PIECING A YARN IN AN OPEN-END SPINNING MACHINE

BACKGROUND OF THE INVENTION

1. Field of the Invention

The present invention relates to a method of piecing a yarn in an open-end spinning machine.

2. Description of the Prior Art

Open-end spinning machines generally operate by allowing a spun yarn from a spinning unit to pass between a draw-off roller and a presser roller, and to be wound around a bobbin positively rotated by a take-up drum while traversing the yarn across the bobbin for forming a package. When the yarn being spun is broken for some reason, a yarn piecing machine is moved toward and stopped in front of the spinning unit where the yarn breakage has occurred, for piecing the yarn.

Variations in the time (hereinafter referred to as a "yarn piecing machine arrival time") which is unavoidable for the yarn piecing machine to reach the spinning unit for yarn piecing have caused the following problems: when a yarn breakage occurs, the feed roller of the spinning unit is stopped to stop a sliver while the latter is being sandwiched between the feed roller and a presser. Since a spinning rotor and a combing roller are idly rotated continuously unless the spinning unit is opened for cleaning by an opening mechanism mounted on the yarn piecing machine, the end of the sliver is gradually scraped off by needles of the combing roller. The variations in the yarn piecing machine arrival time result in different shapes (fiber quantities) of sliver ends. It is necessary to start supplying the sliver by starting the feed roller immediately prior to arrival of the broken yarn end at a fiber collecting surface of the spinning rotor so that when the broken yarn end as inserted in a withdrawal tube of the spinning unit reaches the fiber collecting surface, the fibers also reach the fiber collecting surface at the same time or an earlier time. Experiments have shown that where the pre-feed time between the time of starting the feed roller and the time of arrival of the yarn end at the fiber collecting surface is constant, the timing for the fibers to reach the fiber collecting surface and the shape in which the fibers are deposited on the fiber collecting surface vary dependent on the quantity of the fibers at the sliver end, resulting in different rates of successful yarn piecing.

According to a conventional yarn piecing method, the package is rotated in a reverse direction by a rewinding package-driving roller mounted on the yarn piecing machine to feed the broken yarn end through the withdrawal tube onto the yarn collecting surface in the spinning rotor. When the yarn end is joined to the fibers on the yarn collecting surface, the package is rotated in a normal direction to pull up the yarn. In synchronism with the starting of reverse rotation of the rewinding roller, the sliver supply feed roller in the spinning unit is actuated to supply the fibers into the spinning rotor.

With the above yarn piecing method, the sliver starts being fed by the feed roller at the same time that the rewinding roller starts to rotate in the reverse direction. For adjusting the timing for the broken yarn end to reach the fiber collecting surface of the spinning rotor and also the timing for the fibers loosened by the combing roller to reach the fiber collecting surface at the time when a different yarn number count is employed, it is required to change the speed at which the rewinding roller is to be reversed. This varies the speed at which the yarn is inserted into the withdrawal tube dependent on the yarn number count. Accordingly, the yarn insertion speed becomes inappropriate, so that the yarn may not be inserted properly and may fail to progress in the withdrawal tube, resulting in a reduced rate of successful yarn piecing.

According to the prior yarn piecing process, the package is reversed by a drive roller in the yarn piecing machine to rewind the yarn from the package, and the yarn is gripped by a pair of yarn grip rollers while the yarn end is cut off into a predetermined length. The yarn end is then moved directly above the withdrawal tube in the spinning unit, and thereafter the package and the yarn grip rollers are reversed to insert the yarn into the withdrawal tube. When the yarn end is moved onto the fiber collecting surface and gets pieced, the package and the yarn grip rollers are rotated in the normal direction to draw the yarn out of the withdrawal tube. The yarn is released from the yarn grip rollers and transferred between the draw-off roller and the presser roller. The package is separated off the drive roller and rotated by the take-up drum in the spinning machine for normal spinning operation.

The foregoing conventional yarn piecing process is disadvantageous in that when the yarn spinning speed varies due to a different yarn number count employed, the RPMs of the yarn grip rollers and package drive roller in the yarn piecing machine at the time of yarn withdrawal have to be changed to meet the speed of operation of the spinning machine, requiring high-precision controls which make the entire apparatus complex and costly.

In open-end spinning machines, the RPMs of the rotor, draw-off roller, and take-up drum are preset in a fixed relationship to achieve a predetermined spinning speed dependent on a desired yarn number count and number of twists. The rollers and drum are normally powered by a common drive source. With the above-mentioned prior yarn piecing process, the pieced yarn from the spinning unit is withdrawn by the yarn withdrawal mechanism (the rewinding roller and yarn grip rollers) in the yarn piecing machine. The rollers in the yarn piecing machine are powered by a drive source different from the drive source on the spinning machine base. Therefore, the RPMs of the rollers in the yarn piecing machine do not necessarily synchronize with the spinning speed of the rotor, with the result that the spun yarn may be subjected to variations in thickness and twist, and may be poor in quality. According to another yarn piecing method, the RPM of the rotor is reduced for piecing a yarn at a low speed, and the yarn is withdrawn by the yarn withdrawal mechanism in the yarn piecing machine. After the rotor and the yarn withdrawal mechanism have reached a normal high RPM, the yarn is transferred to the draw-off roller on the machine base. However, the yarn piecing process has had the drawback in that the rate of production is lowered during the time required for the rotor and mechanism to reach the high normal speed from the low speed. Another problem is that the rotor, the combing roller, and the feed roller for a spinning unit with a yarn breakage must be driven by an external drive source different from the drive source on the machine base, so that the entire mechanism is complicated and expensive.

SUMMARY OF THE INVENTION

In view of the foregoing various shortcomings of the prior yarn piecing method, it is an object of the present invention to provide a method of piecing a yarn in an open-end spinning machine, which is capable of winding, on yarn piecing, a yarn with a draw-off roller and a presser roller in the open-end spinning machine, which are adjusted in speed dependent on the yarn number count used, of simplifying the apparatus employed and making the same less costly through the yarn piecing operation that does not require matching the RPM of yarn grip rollers in the yarn piecing machine to the speed of the spinning operation of the spinning machine, of eliminating yarn variations due to different RPMs of a rotor and a yarn withdrawal mechanism to thereby produce a spun yarn of good quality, and of preventing the production rate from being lowered due to low-speed yarn piecing operation.

Another object of the present invention is to provide a method of piecing a yarn in an open-end spinning machine, which is capable of easily adjusting the timing to feed in a sliver without changing the speed of reverse rotation of a rewinding roller into the rotor, that is, the speed at which a yarn is drawn into a withdrawal tube, so that the yarn end will be inserted properly into the withdrawal tube and advanced therethrough for an increased rate of successful yarn piecing.

Still another object of the present invention is to provide a method of piecing a yarn in an open-end spinning machine, which is capable of equalizing the shapes of sliver ends for all spinning units with yarn breakages at the time of yarn piecing even with different yarn piecing machine arrival times, with the result that the rate of successful yarn piecing can be increased without varying the pre-feed time dependent on the yarn piecing machine arrival time.

According to the present invention, there is provided a method of piecing a yarn in an open-end spinning machine, the method comprising the steps of stopping a yarn piecing machine in front of a spinning unit suffering a yarn breakage, reversing a package with a rewinding roller to rewind a yarn therefrom, cutting off the yarn to leave a yarn end having a predetermined length, moving the yarn end to a position upwardly of an outlet of a withdrawal tube in the spinning unit, rewinding the rewinding roller again to feed the yarn end through the withdrawal/tube to a fiber collecting surface of a spinning rotor in the spinning unit, supplying a sliver with a feed roller into the spinning unit, piecing the yarn end to the sliver on the fiber collecting surface, continuously drawing a pieced yarn from the spinning rotor, and moving the pieced yarn to a position between presser roller and a draw-off roller which are being rotated while drawing the pieced yarn from the spinning rotor. The presser roller and the draw-off roller are mounted on the open-end spinning machine and adjustable in speed dependent on the yarn number count used for yarn winding operation during a yarn piecing process. The rate of successful yarn piecing is increased irrespectively of the yarn piecing machine arrival time or the yarn number count used, requires no change in the RPM of the yarn grip rollers in the yarn piecing machine even when the spinning speed of the spinning machine is varied, and hence dispenses with a speed control device.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIGS. 14*a* through 14*l* are side elevational views illustrative of progressive steps of a yarn piecing operation;

DESCRIPTION OF THE PREFERRED EMBODIMENT

Figure 2:
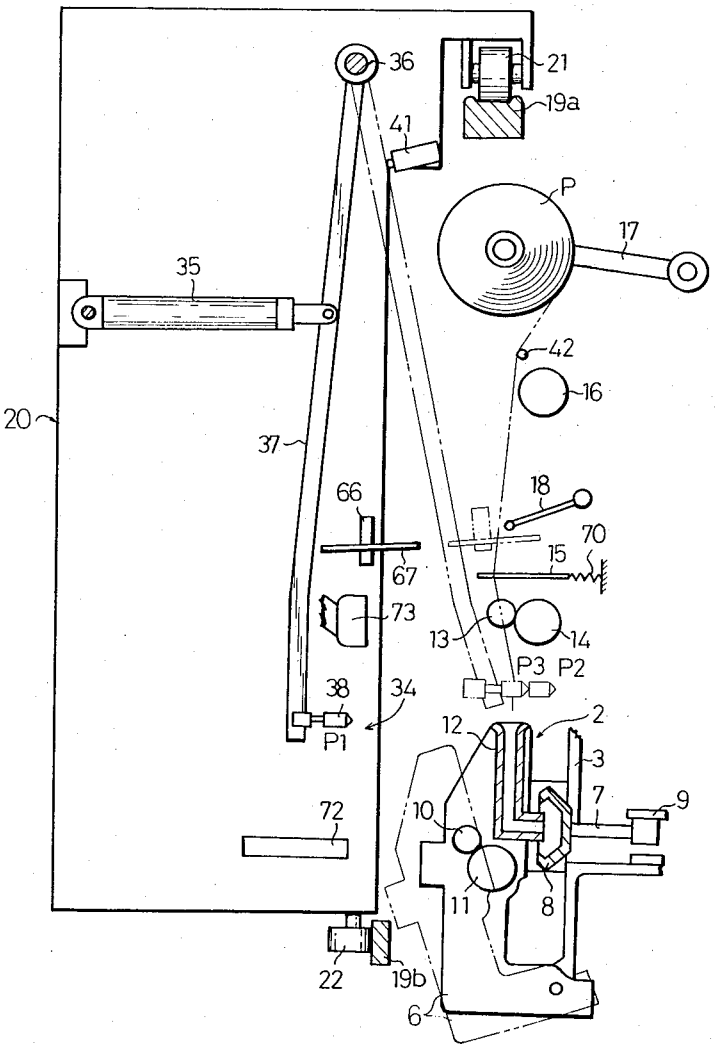
FIG. 2 is a side elevational view of the yarn piecing apparatus of FIG. 1.

A yarn piecing apparatus employed in a yarn piecing method according to the present invention will be described with reference to FIGS. 1 through 13.

An open-end spinning machine 1 includes a spinning unit 2 composed of a fixed body 4 attached to a machine frame 3 and a movable body 6 angularly movable about a shaft 5, the fixed and movable bodies 4, 6 being joined together by a suitable coupling member during operation of the spinning machine. The fixed body 4 has a spinning rotor 8 mounted on a rotatable shaft 7 and rotatable by a belt 9. The movable body 6 has a feed roller 10 for supplying a sliver F, a combing roller 11 for loosening the sliver F and supplying the loosened sliver F to the spinning rotor 8, and a withdrawal tube 12 for drawing a spun yarn Y formed in the spinning rotor 8.

The open-end spinning machine 1 also has a draw-off roller 14 associated with a presser roller 13, a tension feeler 15 serving as a control guide of the invention (described later on), and a traversing drum 16 serving as a take-up drum for forming a package P. The traversing drum 16 traverses the yarn laterally while forming the package P in the shape of a cone on a bobbin B. The bobbin B is supported on a support arm 17 swingable in an arcwise direction and maintained by a push-up mechanism (not shown) to provide a constant distance between the package P and the traversing drum 16 irrespectively of the diameter of the package P. The support arm 17 can be lowered by a lever 18 for lowering the package. The open-end spinning machine 1 also includes upper and lower yarn piecing machine guides 19*a*, 19*b* extending longitudinally of a machine base.

A yarn piecing machine 20 depends from the upper guide 19*a* by means of a roller 21 mounted on an upper portion of the yarn piecing machine 20 and has a roller 22 mounted on a lower end thereof and rollingly movable on and along the lower guide 19*b*. The yarn piecing machine 20 stops in front of a spindle suffering from a yarn breakage for piecing yarns.

The yarn piecing machine 20 has a rewinding roller 25 as a means for reversibly rotating the package P lifted off the traversing drum 16. The rewinding roller 25 is supported on a distal end of a lever 24 swingable by a pneumatic cylinder 23 and held in contact with the package P for rotating the same.

Figure 3:
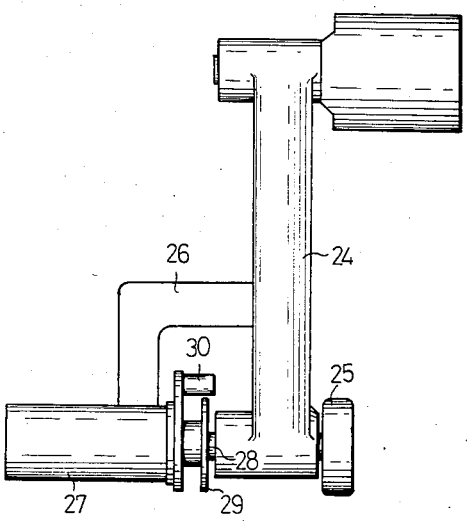
FIG. 3 is a front elevational view of an attachment construction for a rewinding roller.
Figure 4:
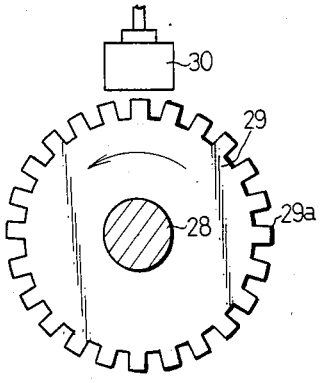
FIG. 4 is an enlarged front elevational view of a pulse generator plate.

As shown in FIG. 3, the rewinding roller 25 is rotatable by a rotatable shaft 28 of a motor 27 fixed by a bracket 26 to the lever 24. As illustrated in FIG. 4, a pulse generator disk plate 29 with a multiplicity of teeth 29*a* provided around a circumferential edge thereof at equal intervals is fitted over the rotatable shaft 28. The motor 27 has a casing on which there is mounted a detector 30 facing the teeth 29*a*. The detector 30 is capable of detecting the number of teeth 29*a* having moved therepast in proportion to the RPM of the rewinding roller 25 and issuing a pulse signal S1 indicative of the RPM of the roller 25.

Figure 5:
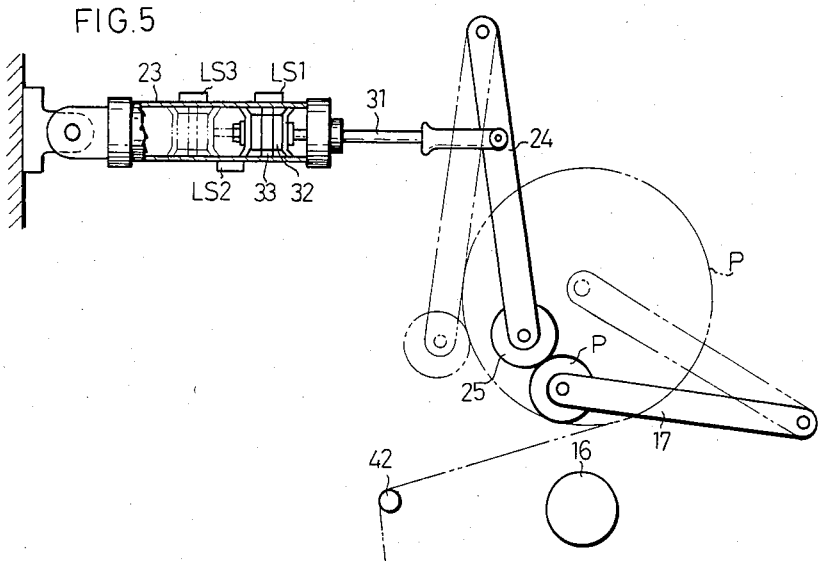
FIG. 5 is a side elevational view of a position switching mechanism for the rewinding roller.

As shown in FIG. 5, the pneumatic cylinder 23 has on its outer peripheral surface three detector switches LS1, LS2, LS3 attached thereto and positionally adjustable in an axial direction of a rod 31 of the cylinder 23. The pneumatic cylinder 23 contains a piston 32 with a magnet 33 fitted thereover. When the positions of the rewinding roller 25, the rod 31, and the piston 32 are changed as the diameter of the package P is varied, the detector switches LS1, LS2, LS3 are turned on one at a time by the magnet 33. Therefore, the detector switches LS1, LS2, LS3 can detect the diameter of the package P in three stages. More specifically, when the diameter of the package P is small as shown by the solid line in FIG. 5, the detector switch LS1 is turned on. When the diameter of the package P is relatively large as indicated by the two-dot-and-dash line, the detector switch LS3 is energized. When the package P has an intermediate diameter, the detector switch LS2 is turned on.

Figure 6:
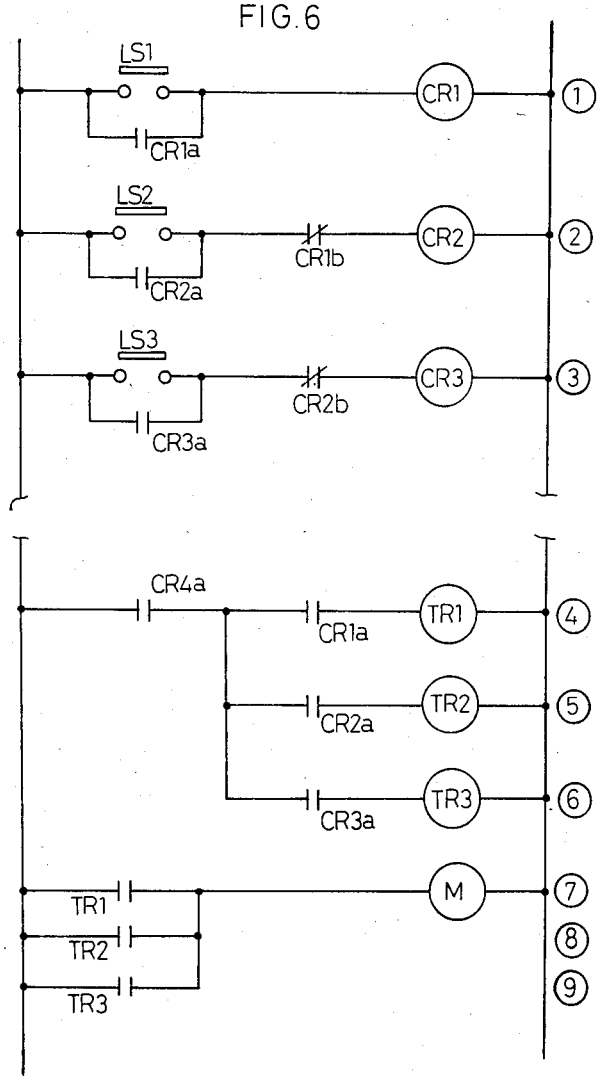
FIG. 6 is a circuit diagram of a timing setting circuit for reverse rotation of the rewinding roller.

FIG. 6 shows a circuit for setting a timing for normal rotation of the motor 27 for the rewinding roller 25. The circuit has first through third timers TR1–TR3 actuatable by contacts CR1*a*–CR3*a* of first through third relays CR1–CR3 energizable by the detector switches LS1–LS3, respectively, and by a contact CR4*a* used for releasing a yarn grip. The timers have time settings having the following relationship: TR1>TR2>TR3. When the package P has a large diameter, the motor 27 starts rotating in a normal direction to pull up the yarn at an early time. When the diameter of the package P is small, the yarn pull-up is delayed.

Figure 1:
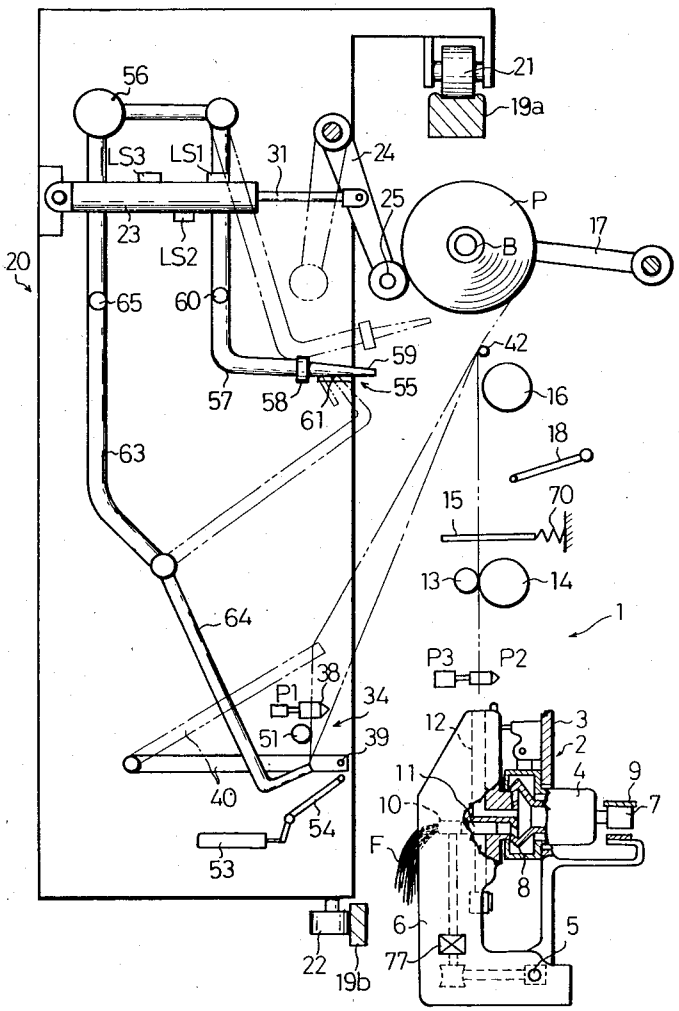
FIG. 1 is a side elevational view of a yarn piecing apparatus employed in a yarn piecing method according to the present invention.

As shown in FIGS. 1 and 2, a yarn feed control means 34 includes a pair of yarn grip rollers 38 mounted on a lower end of a lever 37 pivotably movable by a pneumatic cylinder 35 in forward and backward directions (to the right and left, respectively, in FIG. 1) about a pivot 36, a lever 40 (FIG. 1) having a yarn guide pin 39 on a distal end thereof and swingable by a pneumatic cylinder (not shown), a pneumatic cylinder 41 for moving the lever 37 slightly backward, and a guide 42 for preventing the yarn from contacting the traversing drum 16. The pivotable lever 40 serves to grip the yarn extending from the package P to a second suction nozzle 64 serving as a yarn guide means 55 (described later on) and move the gripped yarn to pass between the pair of rollers 38.

Figures 7, 8, 9, 10, 11, 12:
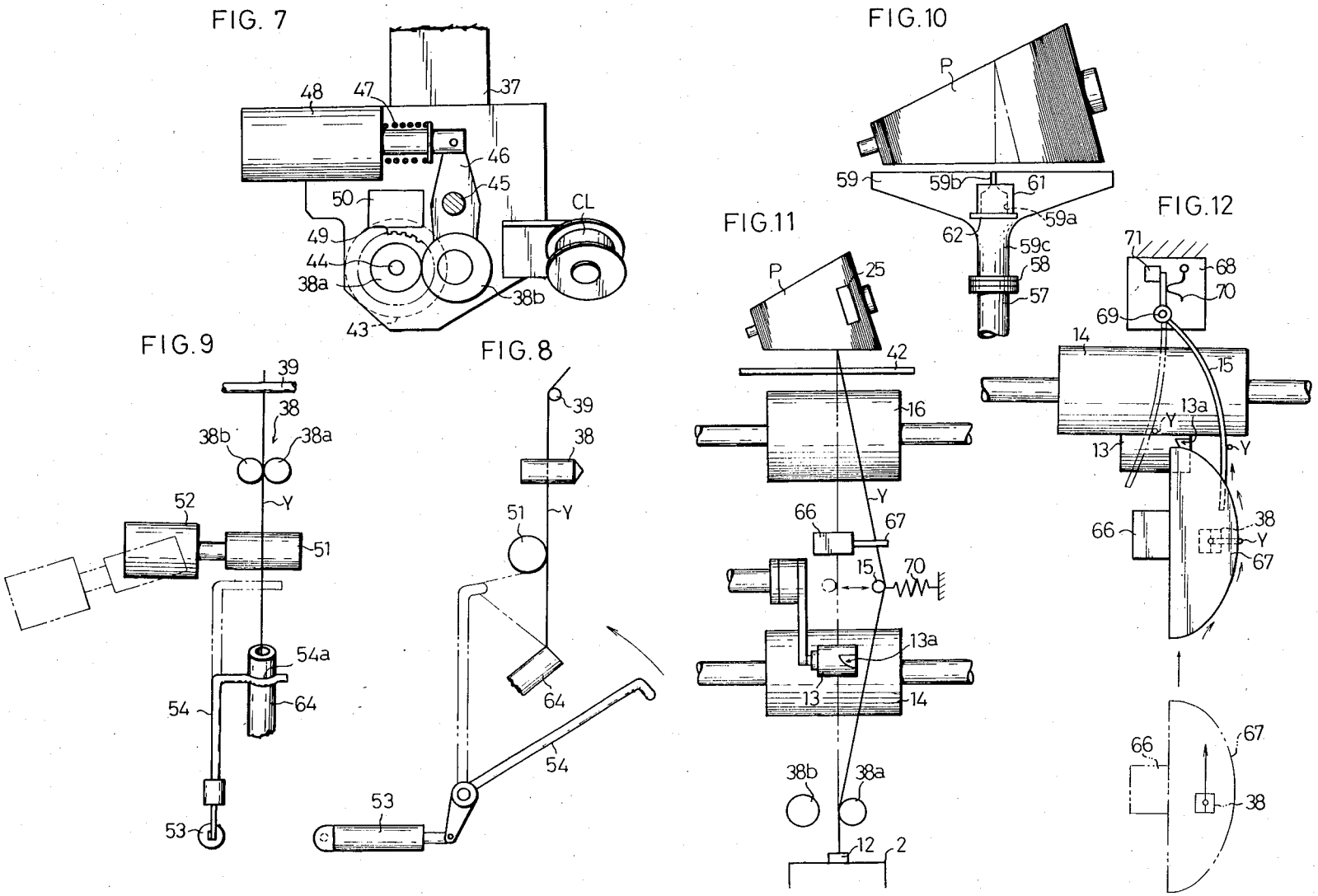
FIG. 7 is an enlarged front elevational view of yarn grip rollers.
FIG. 8 is an enlarged side elevational view of a yarn cutting mechanism.
FIG. 9 is an enlarged front elevational view of the yarn cutting mechanism.
FIG. 10 is an enlarged plan view of a first suction nozzle.
FIG. 11 is an enlarged front elevational view of a mechanism for pulling up a pieced yarn.
FIG. 12 is an enlarged plan view of the mechanism shown in FIG. 11.

As shown in FIG. 7, the pair of rollers 38 include a drive roller 38*a* coupled to a rotatable shaft 44 of a drive motor 43, and a presser roller 38*b* rotatably supported on a lever 46 pivotably mounted on a pin 45. The lever 46 is normally urged by a compression spring 47 in a direction to press the presser roller 38*b* against the drive roller 38*a*. The presser roller 38*b* is angularly movable by a solenoid 48 in a direction away from the drive roller 38*a* against the resilient force of the compression spring 47. A pulse generator plate 49 and a detector 50, which are identical to the pulse generator plate 29 and the detector 30, are mounted respectively on the rotatable shaft 44 of the drive motor 43 and a casing thereof. The detector 50 detects the number of teeth 39*a* on the pulse generator plate 39 which have moved therepast in proportion to the RPM of the drive roller 38*a* and issues a pulse signal S2 indicative of the RPM of the roller 38*a*. An electromagnetic coil CL is mounted alongside of the presser roller 38*b* for issuing a sliver supply signal S3 to the spinning unit 2.

The rollers 38 are movable by the lever 37 angularly moved by the pneumatic cylinder 35 between a position P1 shown by the solid line in FIG. 2 which is displaced off a yarn path during a normal operation of the open-end spinning machine and a position P2 shown by the two-dot-and-dash line which is slightly advanced from the yarn path during the normal operation of the open-end spinning machine. The rollers 38 are also movable by the pneumatic cylinder from the position P2 to a position P3 indicated by the two-dot-and-dash line in FIG. 2 which is aligned with a central axis C of an upper opening 12*a* of the withdrawal tube 12 in the spinning unit 2. The pneumatic cylinder 41 has a piston rod separably held against the lever 37.

As shown in FIGS. 8 and 9, a cylindrical rotary cutter 51 is disposed below the rollers 38 and positively rotatable by a motor 52. The rotary cutter 51 has an outer cylindrical circumferential surface roughened like sandpaper or a file surface for rubbing off the yarn. The rotary cutter 51 is supported on a support arm (not shown) movable by a pneumatic cylinder between an operative position shown by the solid line in FIG. 9 and a retracted position indicated by the two-dot-and-dash line.

An operation arm 54 is disposed below the rotary cutter 51 and movable by a pneumatic cylinder 53 between a retracted position shown by the solid line and an operative position indicated by the two-dot-and-dash line in FIG. 8. The operation arm 54 has a distal end bent into parallel relation to the axis of rotation of the rotary cutter 51 as shown in FIG. 9 and having a recess 54*a* for holding the yarn in a prescribed position.

As illustrated in FIG. 1, the yarn piecing machine 20 has a yarn guide means 55 for holding under suction the yarn from the package P and guiding the yarn to a position directly below the rotary cutter 51. The yarn guide means 55 is composed of a first suction tube 57 connected to a vacuum source 56 and swingable by a pneumatic cylinder (not shown) toward the package P, and a first suction nozzle 59 coupled through an air filter 58 to the suction tube 57 for holding under suction the yarn end in the vicinity of the package P. The first suction tube 57 includes a first switching valve 60. The first suction nozzle 59 has a distal end having an increased width corresponding to the width of the package P. The first suction nozzle 59 has in a lower surface thereof a window 59*a* opening through a slit 59*b* to the distal end of the nozzle 59. A cover 61 is pivotably supported by a pivot 62 on the lower surface of the nozzle 59 for opening and closing the window 59*a*. The cover 61 is controlled by a cam mechanism (not shown) so that it is open when the first suction nozzle 59 is in a stand-by position shown by the solid line in FIG. 1 and closed when the first suction nozzle 59 is in an operative position indicated by the two-dot-and-dash line.

As shown in FIG. 1, the yarn guide means 55 also includes a second suction tube 63 coupled to the vacuum source 56 and a second L-shaped suction nozzle 64 mounted on a distal end of the suction tube 63 for vertical angular movement for entering into the first suction nozzle 59 through the window 59*a* to hold the yarn end under suction and moving the yarn end directly below the rotary cutter 51. The second suction tube 63 includes a second switching valve 65.

As shown in FIG. 2, a package lowering operation member 66 is disposed above the yarn grip rollers 38 and is operable by a pneumatic cylinder (not shown) to push the lever 18 mounted on the spinning machine 1 for lowering the package P onto the traversing drum 16 at the time of piecing yarns. A flat semicircular guide plate 67 (FIG. 12) is fixed to a side of the operation member 66 for guiding the yarn as gripped by the yarn grip rollers 38 to the righthand side of the tension feeler 15 when the yarn is advanced with the yarn grip rollers 38 toward the spinning machine 1.

As shown in FIG. 12, the control guide is in the form of the tension feeler 15 according to the illustrated embodiment, the tension feeler 15 being angularly movable supported by a shaft 69 on a yarn cutting feeler 68 affixed to the spinning machine 1 and normally urged by a spring 70 to turn counterclockwise in FIG. 12. The tension feeler 15 serves to guide the yarn Y between the draw-off roller 14 and the presser roller 13 upon yarn piecing and detect any yarn breakage upon normal yarn spinning. The tension feeler 15 is held by a stopper 71 in a retracted position shown by the solid line in FIG. 12.

As illustrated in FIG. 2, the yarn piecing machine 20 has an opening and closing device 72 for releasing the movable body 6 in the spinning unit 2. The yarn piecing machine 20 also has a cleaning unit 73 having a scraper 85 and a blower 86 (FIG. 13) and movable by a pneumatic cylinder (not shown) toward the spinning rotor 8 for cleaning the interior of the rotor 8 when the movable body 6 is in an open or released position indicated by the two-dot-and-dash line in FIG. 2.

Figure 13:
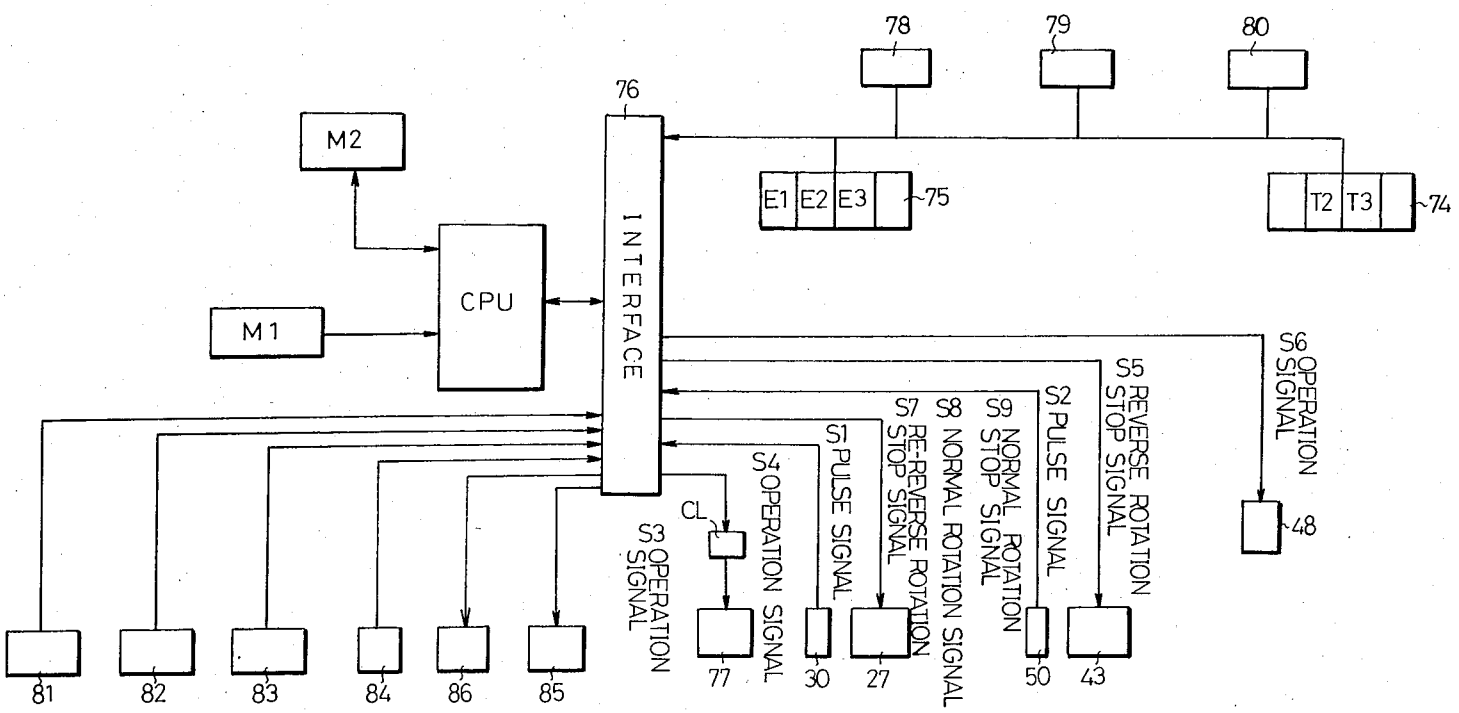
FIG. 13 is a block diagram of a circuit for controlling a yarn piecing operation.

FIG. 13 schematically shows a control circuit mounted on the yarn spinning machine 20 for controlling yarn piecing operation. The control circuit includes a read-only memory M1 for storing a program for yarn piecing operation, a read/write memory M2, a central processing unit CPU, and an interface 76 connecting a timer setting unit 74 for setting various timings, a pulse setting unit 75, the motors 27, 43, the detectors 30, 50, and the solenoid 48 to the central processing unit. The interface 76 issues an operation signal S4 to the electromagnetic coil CL. When the sliver supply signal S3 is issued from the electromagnetic coil CL, an electromagnetic clutch 77 is actuated to cut off the power and to rotate the feed roller 10 in the spinning unit 2.

The control circuit also includes an operation time setting unit 78, a cleaning frequency setting unit 79 and spinning rate setting unit 80, and an operation time detector 81, a cleaning frequency detector 82, a spinning rate detector 83 and a spindle detector 84, the detectors 81 through 83 corresponding to the units 78 through 80 for issuing operation commands to the scraper 85 and blower 86 of the cleaning unit 73.

A yarn piecing process using the yarn piecing machine of the foregoing construction will be described with reference to FIGS. 14*a* through 16.

Figures 14A, 14B, 14C:
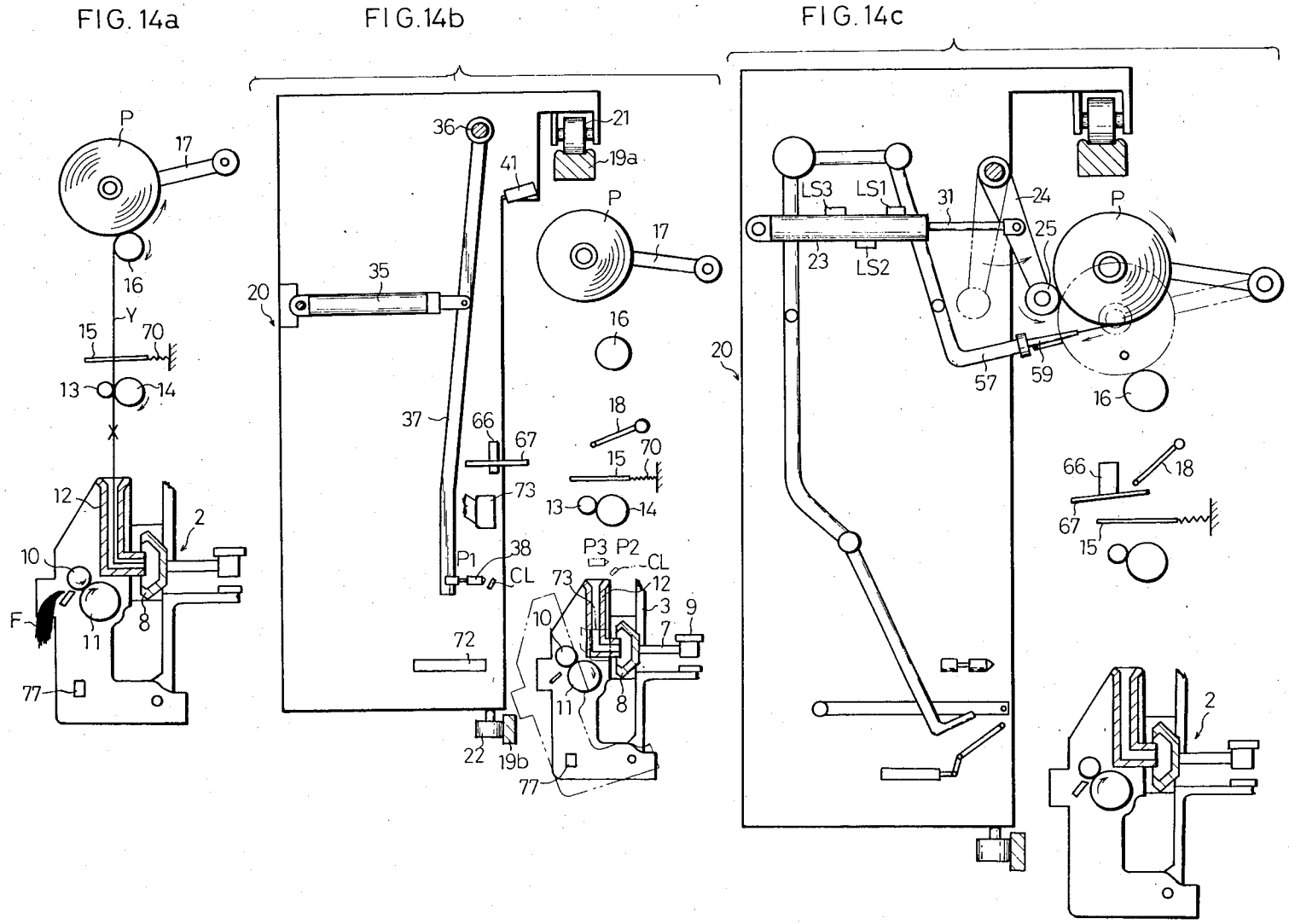

As shown in FIG. 14*a*, a sliver fed by the feed roller 10 in the spinning unit 2 to the combing roller 11 is loosened and broken by the combing roller 11 into fibers which are delivered into the spinning rotor 8 and formed into a yarn Y that is drawn through the withdrawal tube 12. The yarn Y is led between the presser roller 13 and the draw-off roller 14, fed through the tension feeler 15 and the traversing drum 16, and wound on the bobbin B to form a package P. The feed roller 10 and the combing roller 11 are shown schematically in FIGS. 14*a* through 14*l* for a better understanding. The withdrawal tube 12 actually opens at an upper slant surface of the movable body 6. However, for the clarity of illustration, the withdrawal tube 12 is shown opening upwardly.

When the yarn Y is broken at a point X for some reason during normal spinning operation, the yarn breakage is detected by the tension feeler 15 which issues a yarn breakage signal to turn on an indicator lamp (not shown) on the front panel of the spinning unit 2. As the yarn breakage signal is applied to a package push-up mechanism (not shown) of the spinning machine, the package P is lifted upwardly of the traversing drum 16 as shown in FIG. 14*b*, and the electromagnetic clutch 77 is disconnected to stop the rotation of the feed roller 10.

The yarn piecing machine 20 which is moving along the upper and lower guides 19*a*, 19*b* now arrives at a position in front of the spinning unit 2 suffering the yarn breakage, whereupon the yarn piecing machine 20 is stopped in front of the spinning unit 2 as shown in FIG. 14*b* as the spindle detector 84 responds to the indicator lamp. In synchronism with the stoppage of the yarn piecing machine 20, the lever 37 is angularly moved forward to the position P3 about the pivot 36 by the pneumatic cylinder 35, and the electromagnetic coil CL is stopped as shown by the two-dot-and-dash line in FIG. 14*b* in coaction with a reed switch (not shown) disposed above the spinning unit 2. The electromagnetic coil CL is then energized for one second to enable the reed switch to actuate the electromagnetic clutch 77 for the feed roller 10 for one second to supply the sliver F, the end of which is then combed and shaped by the combing roller 11. Then, the lever 37 is swung back by the cylinder 35 to retract the yarn grip rollers 38 and the electromagnetic coil CL to the position P1 indicated by the solid line in FIG. 14*b*.

The opening and closing device 72 is actuated to release the movable body 6 of the spinning unit 2 as shown by the two-dot-and-dash line in FIG. 14*b*. With the movable body 6 thus opened, the cleaning unit 73 is moved toward the rotor 8 as shown by the two-dot-and-dash line to clean the interior of the rotor 8. The cleaning operation is carried out prior to yarn piecing operation as is well known in the art. After the rotor 8 has been cleaned, the cleaning unit 73 is returned from the operative position indicated by the two-dot-and-dash line to the stand-by position shown by the solid line, and the movable body 6 is moved by the opening and closing device 72 back to the solid line position.

Thereafter, as shown in FIG. 14*c*, the lever 24 of the yarn piecing machine 20 is swung by the cylinder 23 in the direction of the arrow until the rewinding roller 25 at the distal end of the lever 24 is pressed against the package P to rotate the latter in a reverse direction.

Where the package P has a large diameter as shown in FIG. 5 by the two-dot-and-dash line and in FIG. 14*c*, at this time, the piston 32 in the cylinder 23 advances a small distance to cause the magnet 33 on the piston 32 to turn on the detector switch LS3. The third relay CR3 in a circuit 3 shown in FIG. 6 is actuated to close the contact CR3*a*.

Then, the first suction tube 47 and the first suction nozzle 59 swings toward the package P until the nozzle 59 has its distal end positioned adjacent to the package P to draw the yarn end under suction. In synchronism with the operation of the lever 24, the operation member 66 is moved to and stopped in the operative position shown in FIG. 14*c*. At this time, the lever 18 is not actuated, and the guide plate 67 approaches the tension feeler 15 as shown by the solid line in FIG. 12.

Figure 14E:
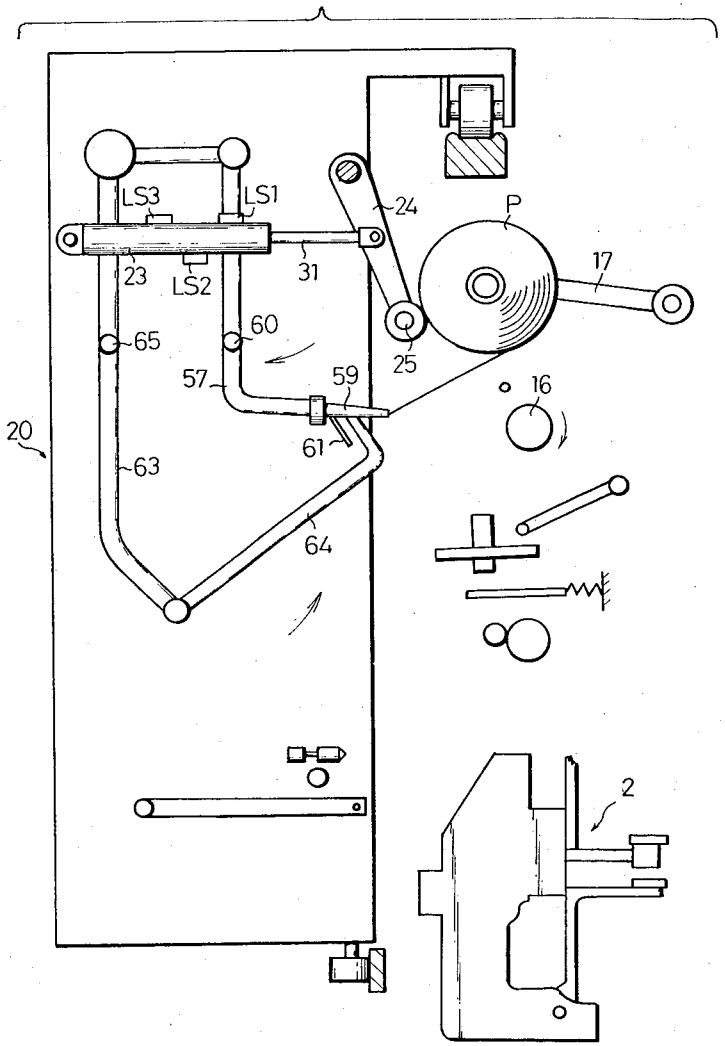
Figure 14D:
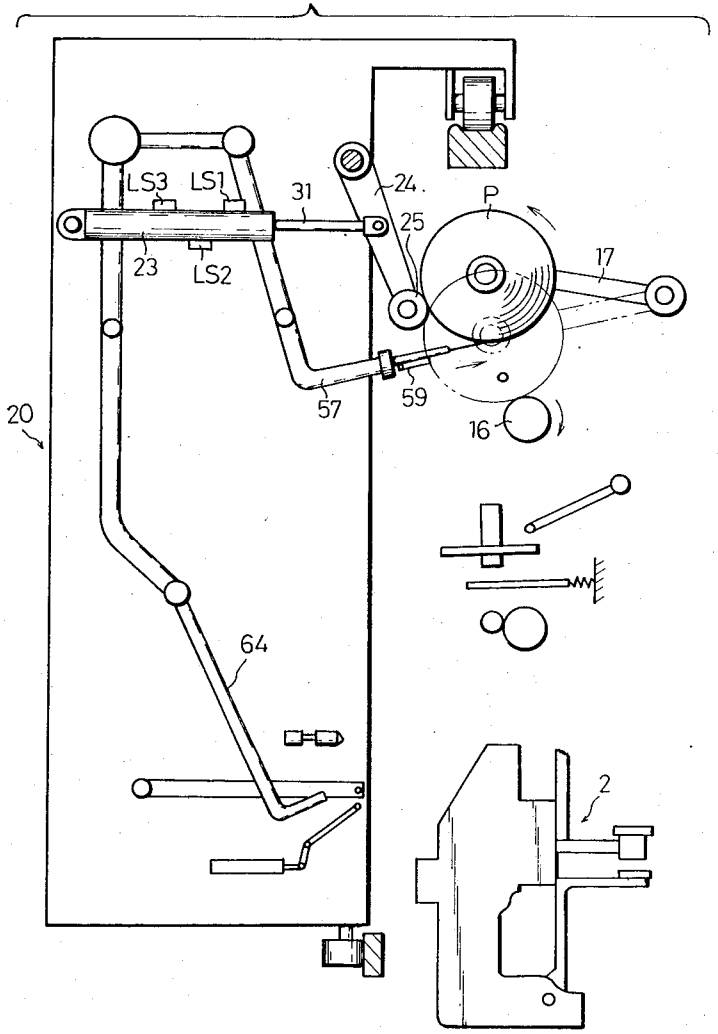

When a predetermined length of yarn is rewound into the first suction nozzle 59 upon reverse rotation of the package P caused by the roller 25, the rewinding roller 25 is rotated in a normal direction as shown in FIG. 14*d* to wind a portion of the rewound yarn on the package P. At this time, the rewound yarn is positioned in a small-diameter portion 59*c* (FIG. 10) of the first suction nozzle 59, and hence the portion of the rewound yarn is wound back on the package P substantially centrally thereof in alignment with the small-diameter portion 59*c*. The rewinding roller 25 is now stopped.

After completion of the above yarn winding operation, the first suction tube 57 and the first suction nozzle 59 are returned to the stand-by position shown in FIG. 14*e*, and the cover 61 is opened. Thereafter, the second suction nozzle 64 is turned upwardly as shown in FIG. 14*e* to cause its distal end to enter the first suction nozzle 59. At the same time, the first switching valve 60 is closed to inactivate the first suction nozzle 59, and the yarn end is now drawn by the second suction nozzle 64. The second suction nozzle 64 is then angularly moved downwardly to extend the yarn from the package P down to a position below the rotary cutter 51 as shown in FIG. 14*f*. The yarn Y extending from the package P to the rotary cutter 51 is held by the guide 42 out of contact with the traversing drum 16.

Then, the lever 40 is turned counterclockwise as illustrated in FIG. 14*f* to allow the yarn Y to be gripped between the rollers 38 and positioned near the rotary cutter 51. After this, the operation arm 54 is turned counterclockwise as shown in FIG. 8 to displace the yarn Y as shown by the two-dot-and-dash line in FIG. 8 between the rotary cutter 51 and the second suction nozzle 64 for bringing an intermediate portion of the yarn Y into contact with the outer peripheral surface of the rotary cutter 51 along a quadrant thereof. The yarn Y is now cut off to provide a predetermined yarn length rewound from the package P. After the yarn has been cut off, the second switching valve 65 is closed to inactivate the nozzle 64.

Figure 14G:
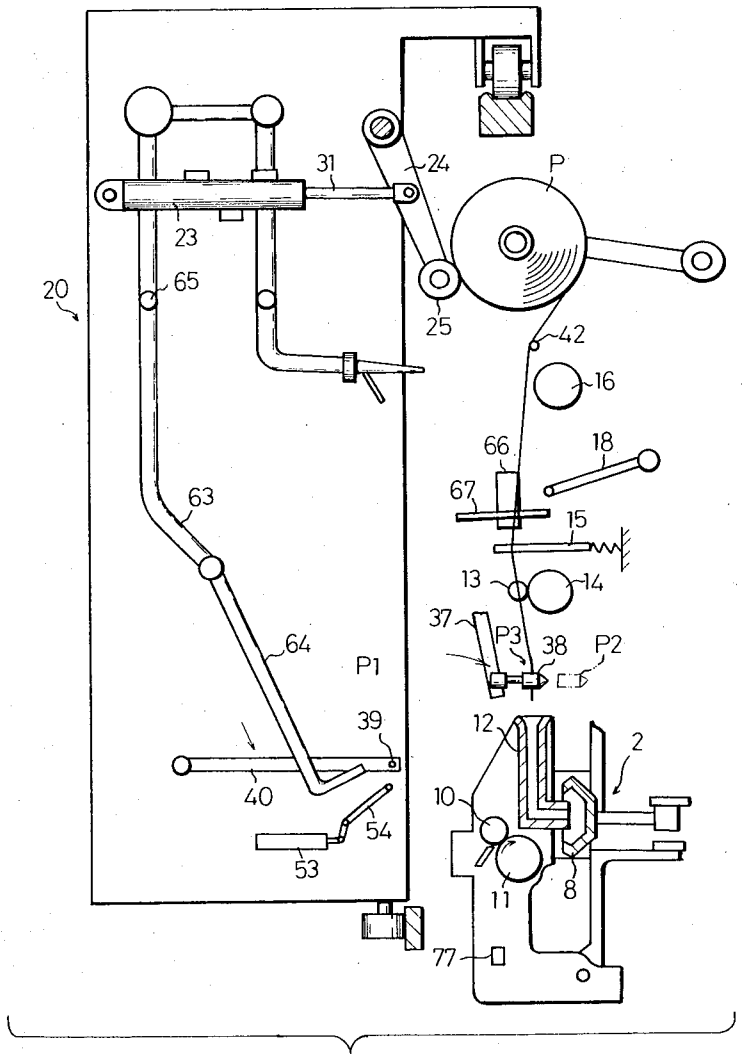
Figure 14F:
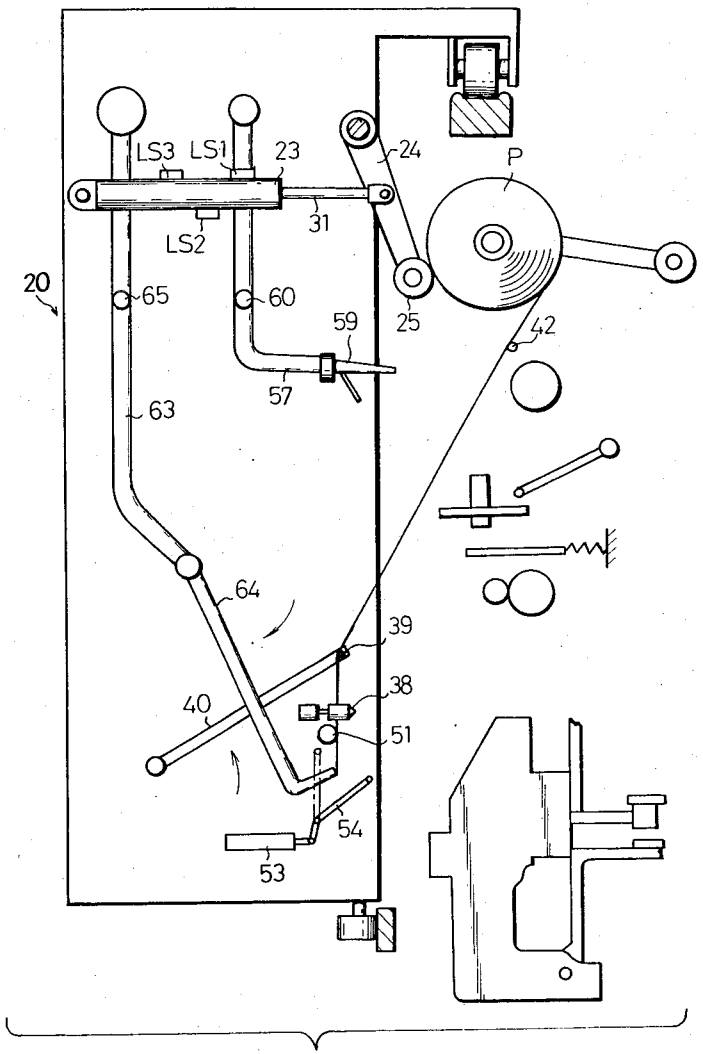

As shown in FIG. 14*g*, the levers 40, 54 are turned clockwise to the stand-by position, and then the lever 37 is tilted forward by the pneumatic cylinder 35 to move the lever 37 and the rollers 38 to the position shown by the two-dot-and-dash line. At this time, the rollers 38 move past the central axis C of the withdrawal tube 12. Since there is a suction air flow through the withdrawal tube 12 into the spinning unit as shown by the arrow in FIG. 15*a*, the end of the yarn Y is drawn downwardly by the suction air flow, and hence is corrected out of any disturbed condition and oriented toward the upper opening 12*a* of the withdrawal tube 12. The lever 37 is thereafter displaced slightly backward by the pneumatic cylinder 41 to move the rollers 38 to the yarn path position P3 indicated by the solid line for normal operation of the spinning machine, so that the yarn end is positioned directly on the central axis C of the outlet of the withdrawal tube 12. Any loosening or slackening of the yarn Y can be eliminated at this time by rotating the rewinding roller 25 in the normal direction. When the rollers 38 are moved forward, the yarn Y is guided by the arcuate surface of the guide plate 67 toward the righthand side of the tension feeler 15 along a passage indicated by the arrows shown in FIG. 12, and then is held by the tension feeler 15 alongside of the presser roller 13 as shown by the solid line in FIG. 11.

Figure 14J:
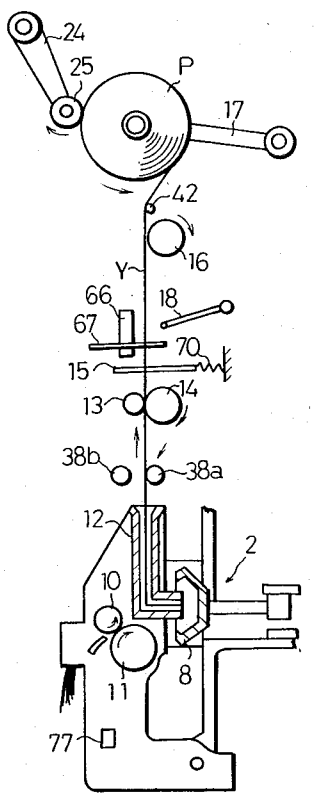
Figure 14I:
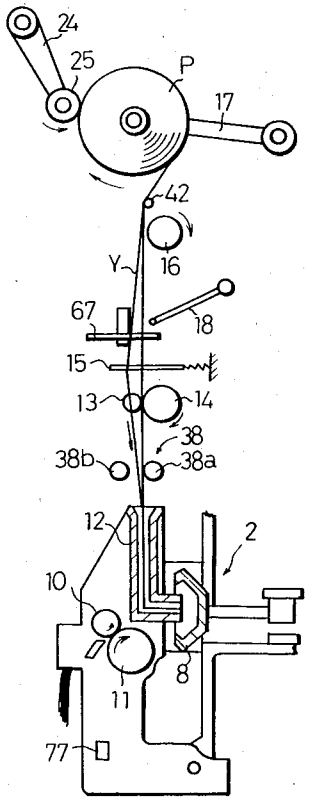
Figure 14H:
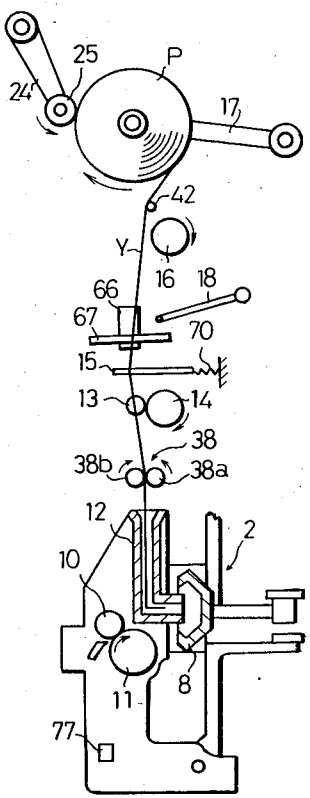
Figure 15A:
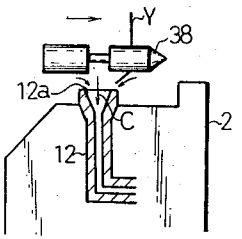
FIGS. 15*a* and 15*b* are enlarged side elevational views explanatory of the manner in which a yarn end is inserted into a withdrawal tube.
Figure 15B:
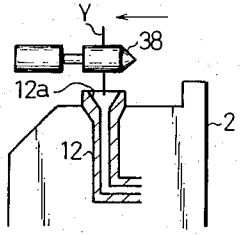

Then, as shown in FIG. 14*h*, the rewinding roller 25 is reversed again, and the rollers 38 (shown angularly displaced through 90°) are also reversed to insert the cut end of the yarn unreeled from the package P into the withdrawal tube 12, whereupon the yarn end is caused under a vacuum in the withdrawal tube 12 to advance therethrough toward the spinning rotor 8. In synchronism with the re-reverse rotation of the rewinding roller 25 and the reverse rotation of the yarn grip rollers 38, the detectors 30, 50 issue pulse signals S1, S2 proportional to the RPMs of the rollers 25, 38. The pulse signals S1, S2 are compared by the central processing unit CPU respectively with reverse RPM settings E1, E2 preset by the pulse setting unit 75. Continued reverse rotation of the yarn grip rollers 38 causes the yarn end to move toward the fiber collecting surface of the spinning rotor 8. When the pulse signal S2 becomes equal to the setting E2, the interface 76 issues a reverse rotation stop signal S5 to the motor 43 for thereby stopping the yarn grip rollers 38 to inactivate the drive roller 38*a*. The interface 76 also issues an operation signal S6 to the solenoid 48 to separate the rollers 38*a*, 38*b* from each other as illustrated in FIG. 14*i*.

Thereafter, the reverse rotation of the rewinding roller 25 is continued to move the yarn end toward the fiber collecting surface. When the pulse signal S1 coincides with the setting E1, the interface 76 delivers a re-reverse rotation stop signal S7 to the motor 27 to stop the roller 25, whereupon the yarn end reaches the fiber collecting surface and is joined to the fibers thereon.

Figure 16:
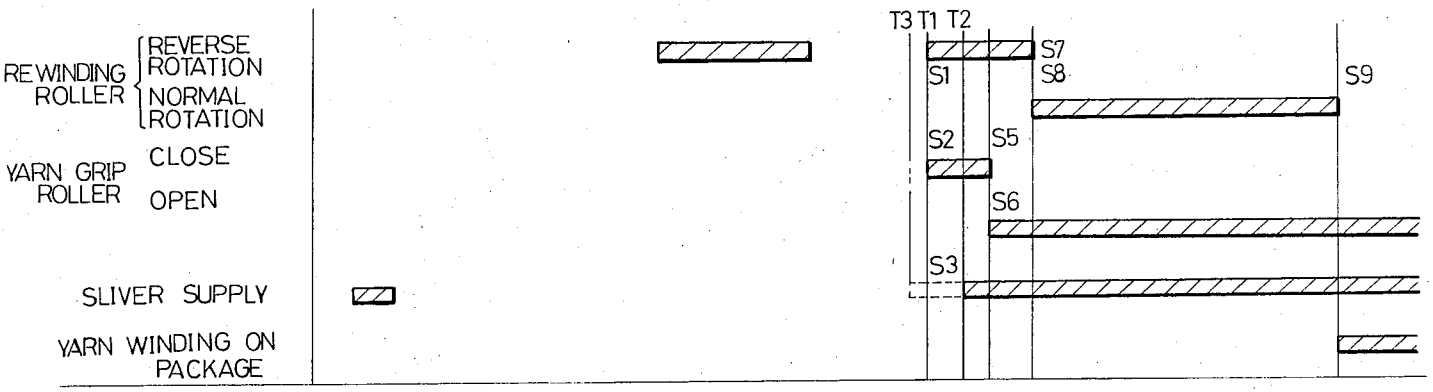
FIG. 16 is a timing chart of a yarn piecing operation.

It is necessary to supply the fibers onto the fiber collecting surface prior to arrival of the yarn end at the fiber collecting surface. This fiber supply can be performed by the timer setting unit 74 capable of changing its time setting before and after a reference time T1 (FIG. 16) when the rewinding roller 25 starts being reversed. More specifically, where a yarn employed has a large yarn number count, the timer setting 74 establishes a time T2, later than the time T1, for enabling the feed roller 10 to supply a sliver, as shown in FIG. 16. The interface 76 issues an operation signal S3 to the electromagnetic clutch 77 to rotate the roller 10 for supplying the sliver. Where a thin yarn is employed, however, it is necessary to actuate the feed roller 10 at a time T3 earlier than the reference time T1, the time T3 being established also by the timer setting unit 74.

During the yarn piecing operation, the yarn Y is subjected to a large tension due to centrifugal forces applied when the spinning rotor 8 rotates at a high speed. Therefore, the tension feeler 15 is moved from the solidline position to the two-dot-and-dash line position in FIGS. 11 and 12 against the resiliency of the spring 70. As a consequence, the yarn Y is moved by a recess 13*a* in the presser roller 13 being rotated into a position between the presser roller 13 and the draw-off roller 14, at which time the yarn Y is pulled up from the withdrawal tube 12 as shown in FIG. 14*j*. Simultaneously with the stoppage of the reverse rotation of the roller 25, the interface 76 issues a normal rotation signal S8 to the motor 27 to rotate the rewinding roller 25 in the normal direction for winding the yarn Y around the package P. The tension feeler 15 is now capable of detecting a next yarn breakage.

When the contact CR4*a* for energizing the solenoid 48 to separate the rollers 38 is turned on, the contact CR4*a* in circuits 4, 5, 6 shown in FIG. 6 is also turned on. Since the contact CR3*a* in a circuit 6 has been turned on by the turn-on of the detector switch LS3, the timer TR3 in a circuit 6 is energized. The timer TR3 is set to energize a relay M for rotating the motor 27 and hence the rewinding roller 25 in the normal direction a predetermined time before the yarn piecing is effected. As a result, the roller 25 is rotated in the normal direction slightly before the yarn end is pieced to the fibers on the fiber collecting surface, and rotates the package P in the normal direction while taking up any slippage between the roller 25 and the package P until the yarn end is pieced. At the same time that the yarn is pieced on the fiber collecting surface as shown in FIG. 14*j*, the yarn Y is pulled up from the spinning rotor 8 and wound around the package P.

Concurrently with the starting of the normal rotation of the rewinding roller 25, the detector 30 issues the pulse signal S1. When the pulse signal S1 is equalized to the normal RPM setting E3 preset by the setting unit 75, the interface 76 issues a normal rotation stop signal S9 to the motor 27 to stop the rotation of the roller 25. As shown in FIG. 14*k*, at the same time that the rewinding roller 25 is stopped, the roller 25 is then brought out of contact with the package P, and the package push-up mechanism is inactivated to move the package P into rolling contact with the traversing drum 16 to rotate the package P in the normal direction, for thereby winding the pieced yarn therearound. The rollers 38 are now moved to the stand-by position as illustrated in FIG. 14*l*. The open-end spinning machine is then in the mode of normal operation.

If the first yarn piecing operation fails, then the yarn piecing machine 20 attempts to start a second yarn piecing operation. If the second and third yarn piecing operations are unsuccessful, then a trouble indicator lamp on the front panel of the spinning unit 2 is turned on, and the yarn piecing machine 20 is moved to a next spinning unit suffering a yarn breakage.

With the yarn piecing method of the present invention, an intermediate portion of the yarn is moved onto the control guide disposed alongside of the presser roller, and then the broken yarn end is inserted into the withdrawal tube in the spinning unit toward the fiber collecting surface of the spinning rotor. Then, at the time the broken yarn end is pieced to fibers on the fiber collecting surface, the control guide is displaced to move the yarn into a position between the presser roller and the draw-off roller while being rotated for drawing out the yarn from the spinning rotor. Therefore, the yarn as it is pieced can be wound by the draw-off roller and presser roller in the open-end spinning machine which are adjusted in speed dependent on the yarn number count used. It is not necessary to match the RPM of the yarn grip rollers in the yarn piecing machine to the speed of spinning operation of the spinning machine. Accordingly, the entire apparatus can be simplified in construction, less costly to manufacture, is capable of producing spun yarns of good quality free from variations in dimension and property, and prevents the rate of production from being lowered.

According to the present invention, furthermore, the timing for the feed roller to feed a sliver is established by the timer setting unit 74 capable of changing its time setting before and after the reference time T1 when the rewinding roller 25 starts being reversed again for inserting the broken yarn end from the package P into the withdrawal tube 12. This can easily adjust the sliver feeding timing without varying the speed of reverse rotation of the rewinding roller, that is, the speed at which the yarn is fed into the withdrawal tube. As a consequence, the yarn end can be inserted into and fed through the withdrawal tube without any error or failure, resulting in an increased rate of successful yarn piecing.

In addition, the end of the sliver is combed and shaped by the combing roller by operating the feed roller for a predetermined time immediately after the yarn piecing machine is stopped in front of a spinning unit in which a yarn is broken. The shapes of the ends of the slivers for all spinning units suffering yarn breakages can therefore be equalized even if there are varying yarn piecing machine arrival times. The rate of successful yarn piecing can be improved without having to change the pre-feed time dependent on the yarn piecing machine arrival time.

The present invention may be modified as follows:

(1) The tension feeler 15 may be replaced with a positively operable control guide mounted on the yarn piecing machine 20 and guided alongside of the yarn presser roller 13. The control guide is positively displaceable in timed relation to yarn piecing in the spinning rotor for moving the yarn into a position between the yarn presser roller 13 and the draw-off roller 14. Both of the tension feeler 15 and such a control guide may be employed. The control guide may have a slit for guiding a yarn thereinto and be positioned on the side of spinning machine base in front of the yarn grip rollers 38 to save space.

(2) Although the tension feeler 15 and the yarn cutting feeler 68 are shown in coaction with each other, they may be independently operable.

(3) Although in the foregoing embodiment the guide plate 67 is mounted on the operation member 66 for guiding the yarn Y as it advances to a position alongside of the tension feeler 15, the guide plate 67 may be dispensed with, and the yarn grip rollers 38 may be advanced and moved sideways for guiding the yarn Y to a position alongside of the tension feeler 15.

(4) While in the illustrated embodiment the yarn piecing machine 20 is equipped with first and second suction nozzles 59, 64, a yarn piecing machine with a single suction nozzle may be employed.

As described above in detail, the yarn piecing method of the present invention can increase the rate of successful yarn piecing irrespectively of the yarn piecing machine arrival time or the yarn number count used, requires no change in the RPM of the yarn grip rollers in the yarn piecing machine even when the spinning speed of the spinning machine is varied, and hence dispenses with a speed control device, so that the entire apparatus can be simplified in construction and less costly to manufacture.

Although a certain preferred embodiment has been shown and described, it should be understood that many changes and modifications may be made therein without departing from the scope of the appended claims.

What is claimed is:

1. A method of piecing a yarn in an open-end spinning machine, comprising the steps of:

(a) stopping said spinning machine, and stopping a yarn piecing machine in front of a spinning unit suffering a yarn breakage;

(i) then operating the sliver feed roller and combing roller of said spinning unit for a momentary predetermined time period to comb and shape the end of said sliver, and (ii) stopping said sliver feed roller and combing roller;

(b) reversing the package on said spinning unit with a rewinding roller to rewind said broken yarn therefrom;

(c) cutting off said yarn to leave a yarn end having a predetermined length extending from said yarn package;

(d) moving said yarn end to a position upwardly of an outlet of the withdrawal tube in said spinning unit and starting the spinning rotor of said spinning unit;

(e) rewinding said rewinding roller again to feed said yarn end through said withdrawal tube to a fiber collecting surface of the spinning rotor in said spinning unit and starting a timer at a time determined by the time when said rewinding starts again, after adjusting the starting time of the timer according to the yarn count number of the yarn to be pieced;

(f) operating said sliver feed roller in response to said timer for supplying said sliver to said fiber collecting surface of said spinning rotor;

(g) piecing said yarn end to said sliver on said fiber collecting surface;

(h) continuously drawing said pieced yarn from said spinning rotor; and (i) moving said pieced yarn to a position between a presser roller and a draw-off roller which are being rotated while drawing the pieced yarn from said spinning rotor.

2. A method according to claim 1, wherein said pieced yarn is moved to the position between the presser roller and the draw-off roller by a yarn control guide mounted on the yarn piecing machine.

3. A method according to claim 1, wherein the RPM of the re-reverse rotation of said rewinding roller is detected as a pulse signal indicative of and proportional to said RPM to stop the reverse rotation of said rewinding roller when the number of pulses of said pulse signal reaches a present count number.

4. A method according to claim 1, wherein a diameter of said package is detected, a timing for said rewinding roller to wind the yarn on said package is set by a detected signal indicative of the package diameter, and said rewinding roller is rotated in a normal direction based on said set timing to draw the yarn from said spinning rotor.

* * * * *